US005624319A

United States Patent [19]

Golczyk et al.

[11] Patent Number: 5,624,319

[45] Date of Patent: Apr. 29, 1997

[54] PROCESS FOR PRODUCTION OF A TWO-PART CAGE NUT

[75] Inventors: Ralph Golczyk, Grenzach-Wyhlen; Klaus Hullmann, Lörrach, both of Germany

[73] Assignee: A. Raymond GmbH & Co. KG, Germany

[21] Appl. No.: 528,813

[22] Filed: Sep. 15, 1995

[30] Foreign Application Priority Data

Sep. 20, 1994 [DE] Germany ..... 44 33 470.2

[51] Int. Cl.[6] ..... B21D 53/24

[52] U.S. Cl. ..... 470/21; 470/25; 72/334; 72/379.2; 411/113; 411/432

[58] Field of Search ..... 470/18, 19, 20, 470/21, 25; 72/334, 348, 356, 379.2; 411/111, 112, 113, 108, 432, 965, 999

[56] References Cited

U.S. PATENT DOCUMENTS

| | | | |
|---|---|---|---|
| 2,282,851 | 5/1942 | Burke | 470/20 |
| 4,762,451 | 8/1988 | Collins | 411/177 |
| 4,875,816 | 10/1989 | Peterson | 411/104 |
| 5,096,350 | 3/1992 | Peterson | 411/112 |

FOREIGN PATENT DOCUMENTS

0391764B1 3/1990 European Pat. Off. .

*Primary Examiner*—Lowell A. Larson
*Assistant Examiner*—Thomas C. Schoeffler
*Attorney, Agent, or Firm*—Gifford, Krass, Groh, Sprinkle, Patmore, Anderson & Citkowski, P.C.

[57] ABSTRACT

A process for production of a two-part cage nut from a single metal plate. The cage nut includes a nut slidably carried on a holding part. The nut includes a base plate having a threaded sleeve. The holding part includes a holding plate having an aperture and a pair of side walls which are bent over the edge of the base plate of the nut. The process production includes stamping the holding part and nut from a single metal plate. The nut is joined to the base plate by a narrow connecting web. The base plate is then bent about the connecting web and positioned over the holding plate between the side walls. The side walls are bent inwardly until they extend over the side edges of the base plate of the nut. The nut is separated from the holding plate by shearing off the now bent over portion of the connecting web. The nut is permitted to slide between boundary tabs on a guide path between the side walls.

8 Claims, 2 Drawing Sheets

PROCESS FOR PRODUCTION OF A TWO-PART CAGE NUT

BACKGROUND OF THE INVENTION

I. Field of the Invention

The present invention relates in general to a process and a product-by-process of a two-part cage nut and, more particularly, to a process and product-by-process of forming a two-pan cage nut from a single metal plate.

II. Background of the Invention

Cage nuts having a nut slidably mounted on a holding pan are well known. The nut is formed with a socket which may be threaded for receiving a machine screw or unthreaded for receiving a self-tapping screw. The holding part has a pair of opposed lateral walls which form a "cage" to guide the nut along a slide path on the holding part. The holding part is rigidly mounted to a wall or carrier plate for the mounting of a component. The slidable mounting of the nut in the cage part permits positioning of the nut within certain limits along the guide path to provide a tolerance for the mounting of the component.

Cage nuts are typically produced by forming the holding part and the nut separately, such as disclosed in European Patent No. 0391764B1 to Dubost. The holding part is formed with the lateral walls from one piece of metal, and the nut part is stamped out in a separate operation from another piece of metal. The nut is formed with a base plate having edges. The nut is then positioned on the holding plate and the lateral walls of the holding plate are bent inwardly to cover the edges of the base plate and assemble the parts together. However, such a process is relatively expensive because the two parts are produced in separate operations and then the parts are positioned and assembled together in a separate manufacturing step.

It is, thus, an object of the invention to provide a process for producing a two-part cage nut which is less expensive than previously known methods and processes.

It is another object of this invention to provide a two-part cage nut which is formed from a single metal plate.

These and other objects of the invention are accomplished by the invention as disclosed below.

SUMMARY OF THE INVENTION

In accordance with the invention, a two-part cage nut is formed by a process which includes forming both a holding part and a nut from a single elongated metal plate. A cylindrical sleeve for the nut is formed at one end of the metal plate. The metal plate is then stamped to form a narrow connecting web joining the nut to the holding plate. A pair of lateral side walls are shaped during the stamping operation and then raised or bent 90° to the surface of the holding part. The nut is then pressed towards the holding part to bend the connecting web in a U-shaped pattern and position the nut over the holding part between the raised side walls. The side walls are then bent inwardly towards each other until the side walls are angled to cover a portion of the nut. Finally, the nut is separated from the holding part by shearing off the U-shaped portion of the connecting web portion.

Because the nut is not separated from the holding part until the last manufacturing step, the holding part and nut can be produced in a continuous manufacturing sequence on the same production tooling. Additionally, the mounting of the nut can be integrated into the production tooling.

Accordingly, it is advantageous to form boundary tabs to limit the travel of the nut at both ends of the holding part during the stamping process. The tabs are then bent into a retaining position after the nut is positioned over the holding plate and the connecting web is sheared off even with an outer surface of the boundary tabs.

BRIEF DESCRIPTION OF THE DRAWING

Additional objects, advantages and features of the present invention will become apparent from the following description of the pendent claims, taken in conjunction with the accompanying drawings in which:

DETAILED DESCRIPTION OF THE PREFERRED EMBODIMENTS

Figure 2:
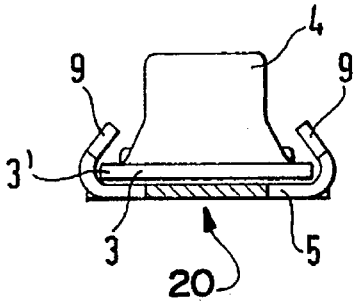
FIG. 2 is a sectional view of the cage nut taken along lines II—II in FIG. 1.
Figure 3:
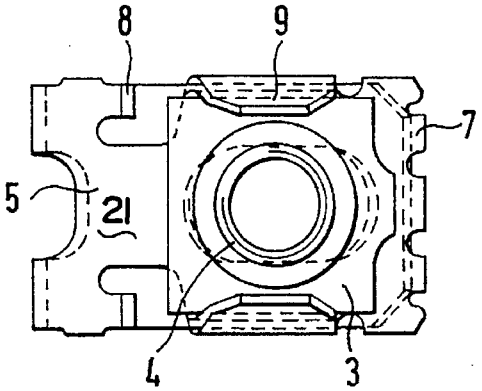
FIG. 3 is a plan view of the cage nut taken in accordance with the invention.
Figure 4:
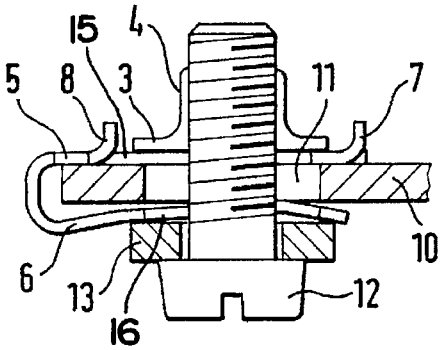
FIG. 4 is a cross-sectional view of the cage nut assembled in position on a carrier plate with a screw.

A two-part cage nut 20 formed in accordance with the process of the invention is shown in FIGS. 1–4. The cage nut 20 is slidable for adjustably mounting a component to a carrier plate 10 or frame (FIG. 4). The cage nut includes a holding part 1 and a nut 2. As discussed below, the nut 2 is assembled to slide on the holding part 1. The cage nut 20 thus facilitates mounting of the component by permitting movement of the nut to provide a tolerance in the alignment of the component and fastener.

Figure 1:
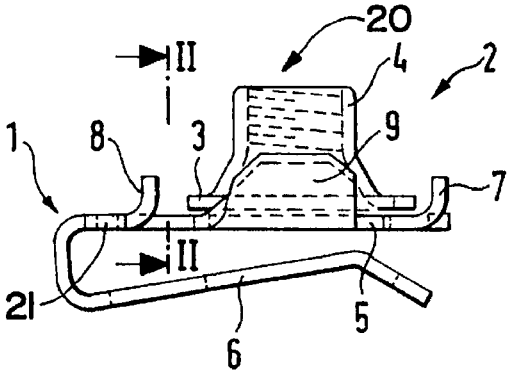
FIG. 1 is a side elevation of a cage nut produced according to the invention.

As best shown in FIGS. 1 and 3, the nut 2 includes a base plate 3 and threaded socket or sleeve 4 extending outwardly therefrom. The base plate 3 has a pair of opposed side edge portions 3'. The sleeve 4 is a deep drawing process.

As shown in FIG. 1, the holding part includes a slide plate 5 and a clamping arm 6. A connecting portion 21 extends between the slide plate 5 and the clamping arm 6. The clamping arm 6 is formed to extend parallel with the slide plate 5 to provide a generally C-shaped profile for mounting to the carrier plate 10. A pair of outer limit tabs 7 extend normally from a free end of the slide plate 5. A pair of inner limit tabs 8 extend from the clamping arm on either side of the connecting portion 21. The pairs of limit tabs 7 and 8 are formed to define the limits of a slide path for the nut 2 along the slide plate 5.

As shown in FIGS. 2 and 3, the holding plate has a pair of spaced apart lateral side walls 9 extending inwardly towards each other over the edges 3' of the base plate 3 on the nut 2. The side walls 9 guide the nut 2 as it slides on the guide path between the outer limit tabs 7 and inner limit tabs 8. An oval passage hole 15 is formed in the slide plate 5 to extend along the guide path to receive a fastener or screw 12.

A like oval passage hole 16 is formed in complementary alignment with the passage hole 11.

As shown in FIG. 4, the cage nut 20 is utilized for mounting a component by sliding the carrier plate 10 between the clamping arm 6 and slide plate 5. The cage nut 20 is aligned on the carrier plate 10 so that the oval hole 11 in the carrier plate is aligned with the oval passage hole 15 in the slide plate 5 and the oval passage hole 16 in the clamp arm 6. A screw 12 may be then inserted through an aperture of a fastening portion 13 of the component and the holes 11, 15 and 16 and be received in the sleeve 4 of the nut 2.

Figure 5:
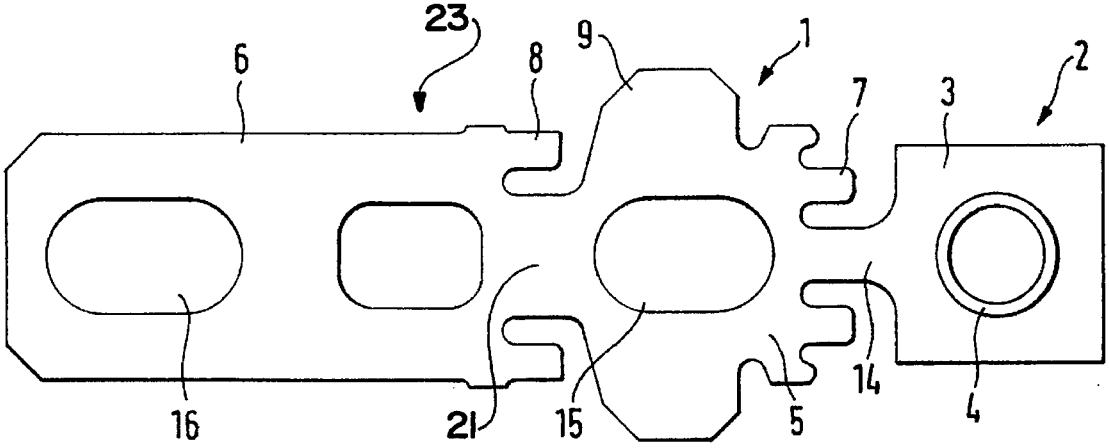
FIG. 5 is a plan view of the metal plate used in the process of forming the two-part cage nut in accordance with the invention.

In a novel process, the holding part 1 and nut 2 are stamped from a single metal plate into a stamping 23 shown in FIG. 5. The threaded sleeve 4 of the nut 2 is formed first in the plate before stamping by deep drawing. A connecting web 14 is formed between the nut 2 and holding part 1. The holes 15 and 16, tabs 7 and 8, side walls 9, and connecting web 21 are also formed during stamping.

Figure 6:
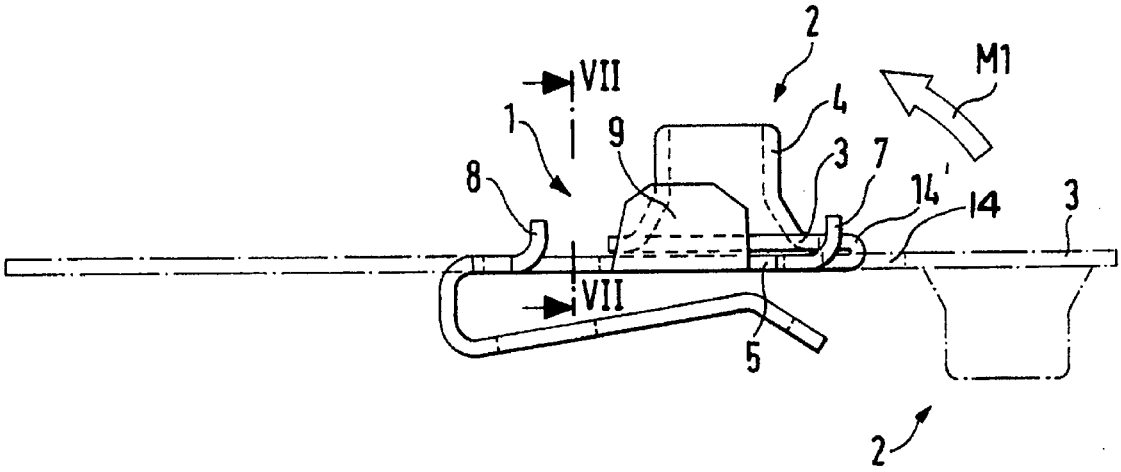
FIG. 6 is a side view showing the cage nut during a bending step in the process of forming.
Figure 7:
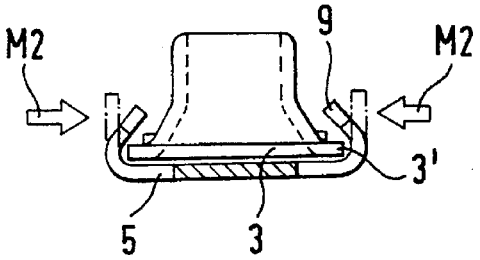
FIG. 7 is a sectional view of the cage nut taken along lines VII—VII after the side walls have been bent inwardly in accordance with the process of forming.
Figure 8:
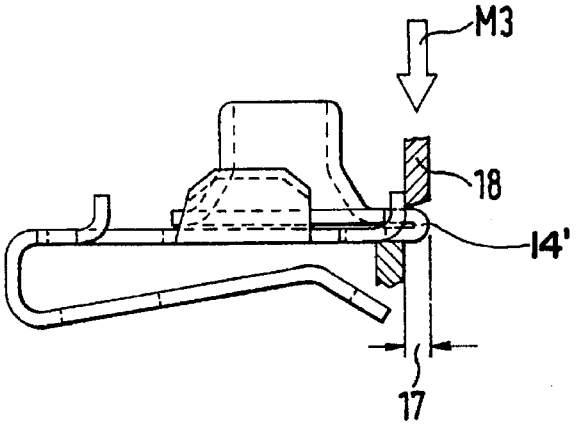
FIG. 8 is a side view of the two-part cage nut in a sheafing step in accordance with the process of forming.

The cage nut 20 is assembled from the stamping 23 in the sequence shown in FIGS. 6–8. As shown in FIG. 6, the side walls 9 and limit tabs 7, 8 are first raised to be generally perpendicular to the side path of the slide plate 5 and the clamping arm 6 is formed by folding the outer portion of the holding part beneath the slide plate 5. The nut 2 is then moved in the direction of arrow M1 upwardly to bend about the connecting web 14 to form a U-shaped portion 14'. The nut 2 is pressed downwardly between the raised side walls 9 between the inner and outer limit tabs 7, 8 to be positioned parallel with the surface of the slide plate 5.

As shown in FIG. 7, the two side walls 9 are then bent inwardly towards each other in the direction of arrows M2 until the walls 9 extend over the side edges 3' of the base plate 3 of the nut 2. Clearance is provided between the side walls 9 and side edges 3' to permit the base plate 3 of the nut to be easily slidable along the slide plate 5.

As shown in FIG. 8, the nut 2 is separated from the slide plate 5 by removing the U-shaped portion 14' of the connecting web 14 by a shear or cutter blade 18 which is moved in the direction of arrow M3. The U-shaped portion 14' of the web is sheared off at the outer surface of the outer limit tabs 7. Thus, a greater portion 17 of the connecting web 14 is cleanly removed from both the nut 2 and slide plate.

Thus disclosed is a process of producing a two-part cage nut from a single metal plate. Because the nut is not separated from the holding plate until the last working step, the holding part and nut may be produced on the same production tooling and assembled in a continuous working sequence.

Finally, the assembly of the nut to the holding part may be performed with the same production tooling.

As will become apparent to one with ordinary skill in the art, the preferred embodiment of the invention has been set forth in the drawings and specification, and although specific terms are employed, these are used in a genetic descriptive sense only and are not used for purposes of limitation. Changes in the form or portions of the parts as well as the substitution of equivalents are contemplated as circumstances may suggest or render expedient without departing from the spirit or scope of the invention as further defined in the following claims.

Having thus described our invention, we claim:

1. A method of forming a two-piece metal cage nut, said method comprising the steps of:

forming a base plate having a sleeve adjacent one end;

stamping said base plate to form a connecting web joining a nut to a holding portion having a slide path between a pair of side walls;

bending said nut about the connecting web to a position over said slide path between said pair of side walls;

bending said side walls inwardly to extend over a pair of edge portions of said nut portion; and shearing said web to separate said nut portion from said holding portion.

2. The method of claim 1, further comprising bending said side walls at a right angle to said slide path before said bending said nut path.

3. The method of claim 2, further comprising forming a pair of limit tabs on said holding portion.

4. The method of claim 3, wherein said step of bending said side walls further comprises bending said pair of limit tabs.

5. The method of claim 1, wherein said shearing step further comprises shearing said connecting web to extend even with a limit tab.

6. A two-part cage nut having a nut slidably attached to a holding part wherein said cage nut having the improvement comprises:

said holding part having a pair of side walls formed from an elongated metal plate; and said nut is formed from said metal plate by forming a connecting web between said nut and said holding part, then by bending said connecting web to position said nut over said holding part, then by bending said pair of side portions inwardly to extend over an edge portion of said nut and then by shearing off a portion of said connecting web to permit said nut to slide on said holding part.

7. The cage nut set forth in claim 6, wherein said holding part comprises limit tabs formed by stamping when said connecting web is formed.

8. The cage nut as set forth in claim 7, wherein said holding plate further comprises;

said side walls and said limit tabs being bent generally 90° to said holding part after said holding part is stamped.

* * * * *